US005388647A

United States Patent [19]

McGlothlin

[11] Patent Number: 5,388,647

[45] Date of Patent: Feb. 14, 1995

[54] SUCKER ROD BACK OFF TOOL

[76] Inventor: Charles E. McGlothlin, P.O. Box 1583, Hobbs, N. Mex. 88240

[21] Appl. No.: 17,692

[22] Filed: Feb. 12, 1993

[51] Int. Cl.[6] ..... E21B 31/00; B25B 13/46

[52] U.S. Cl. ..... 166/301; 166/77.5; 81/57.16

[58] Field of Search ..... 166/77.5, 78, 301; 81/57.16, 57.18, 57.19, 57.2, 57.21, 57.34

[56] References Cited

U.S. PATENT DOCUMENTS

| | | | |
|---|---|---|---|
| 2,217,238 | 10/1940 | Sisson | 166/77.5 |
| 2,295,720 | 9/1942 | Dietzmann et al. | 166/77.5 |
| 2,854,216 | 9/1958 | Bjalme | 166/77.5 |
| 2,967,446 | 1/1961 | Martois | 81/57.16 |
| 3,771,389 | 11/1973 | Coyne | 81/57.16 |
| 4,357,843 | 11/1982 | Peck et al. | 81/57.18 |
| 4,622,869 | 11/1986 | Lee | 81/57.46 |
| 5,150,642 | 9/1992 | Moody et al. | 81/57.2 |

*Primary Examiner*—Ramon S. Britts
*Assistant Examiner*—Frank S. Tsay
*Attorney, Agent, or Firm*—Wendell Coffee

[57] ABSTRACT

A power tubing tong is modified by removing the gripping jaws and in attaching a sucker rod break-out adapter where the gripping jaws would normally be placed. The adapter includes a vise anvil and a vise block so that a sucker rod may be securely, rigidly fastened by a vise bolt moving the vise block so that the sucker rod is between the vise block and the vise anvil. This provides a tong capable of breaking a sucker rod joint when the pump attached to the bottom of the sucker rod is stuck. In use, the adapted tong would be used to break a sucker rod at some point between the surface of the earth and the pump when it was desired to pull the pump for routine maintenance and repair.

7 Claims, 3 Drawing Sheets

SUCKER ROD BACK OFF TOOL

CROSS REFERENCE TO RELATED APPLICATION

None, however, Applicant filed Disclosure Document Number 316,966 on Sep. 8, 1992 which document concerns this application; therefore, by separate paper it is respectfully requested that the document be retained and acknowledgments thereof made by the Examiner. (MoPEP 1706)

BACKGROUND OF THE INVENTION (1) Field of the Invention

This invention relates to deep wells and more particularly with the removing of sucker rod and pump elements from oil wells for maintenance purposes. A pulling rig operator is one having ordinary skill in this art.

(2) Description of the Related Art

Most oil is produced today by reciprocating pumps which operate deep within the ground. Typically these wells include tubing within a casing. A pump is located on the bottom of the tubing. It is not unusual for these pumps to be located 10,000 feet below the surface of the earth. Normally, pump elements are attached to a sucker rod string which extends through the tubing to the bottom of the tubing. Normally, most of the working elements of the pump can be removed from the well by pulling the sucker rod inasmuch as working elements of the pump are attached to the sucker rod. Therefore the pump can be maintained or repaired by pulling the sucker rod with the pump elements attached to it.

As used herein, the term "pulling" includes not only the linear upward movement of a string (sucker rod or tubing) but also breaking the joints of the individual sucker rod elements from the string. The term "breaking the joint" basically means unscrewing the threaded joints connecting one portion of the string to another. Normally the sucker rods or tubing will be in lengths no greater than about 30 feet so that they can readily be removed from the well by pulling.

Usually the sucker rod and pump element may be removed from the well by upward, vertical tension upon the portion of the sucker rod extending above the ground. Normally this tension will pull the pump element attached to the sucker rod free of the portion of the pump that is attached to the tubing. Then, when a joint or two of the sucker rod is pulled above the top of the tubing, the sucker rod joint is broken by the use of a sucker rod tong which is normally a rather light unit which produces sufficient torque to break the sucker rod joints.

Tubing tongs are heavier tongs than sucker rod tongs or tubing tongs and produce more torque than that produced by sucker rod tongs. Tubing tongs are normally used to break tubing joints.

In certain instances the pump elements or portions of the sucker rod may be stuck within the well. The sticking occurs because of corrosion or other causes. Regardless of the cause, in certain cases, the pump element attached to the sucker rod cannot be freed from the pump portions attached to the tubing.

When this occurs, normally the sucker rod is broken at some joint below the surface of the earth or ground. This is accomplished by rotating the top of the sucker rod until some joint in the string between the top and the bottom unscrews. Hopefully this might be a joint deep within the well near the pump. In any event, to develop sufficient torque in the sucker rod to cause some joint to break or unscrew, it is often necessary to rotate the sucker rod as many as 200 revolutions. The sucker rod string will seldom break or unscrew with less than 60 or 70 revolutions.

Due to the resilience of the sucker rod material, as well as the certain amount of resilience in the tubing material, when a joint in the sucker rod string does come unscrewed, this is often a traumatic and violent occurrence. Energy has been stored into the down-hole strings and the release of this energy is a tremendous thing. In certain cases the grip or the element attached to the sucker rod above the top of the ground, will slip so that there is a release of energy at this time rather than the breaking of a joint down hole. In such instances, workmen are often injured, and equipment on the pulling rig is damaged.

Normally sucker rod tongs will not produce sufficient torque to break a joint down hole. Other workers in the field have sought to solve this problem.

Before this invention, others had patented related articles. For example, RUSSELL U.S. Pat. No. 4,844,171 discloses an adapter to use tubing tongs for rod tongs. However, RUSSELL is concerned with disconnecting above the surface of the earth as RUSSELL shows wrench 144 to hold one portion stationary as the second portion is rotated.

AUSTIN U.S. Pat. No. 2,450,103 discloses a vise operated by a vise bolt to clamp a sucker rod. AUSTIN discloses a hand-operated wheel for rotating the sucker rod. The AUSTIN device was designed to break the rod string at some point below the surface of the earth.

DIETZMANN discloses a sucker rod tool which holds the sucker rod by a vise which has a manual operation for rotating the sucker rod to break the rod string below the earth.

SUMMARY OF THE INVENTION (1) Progressive Contribution to the Art

According to this application a sucker rod break-out attachment is constructed. The break-out attachment includes a vise which includes a "V" groove which may be clamped to the sucker rod with great force. The adapter is made to fit a standard, common, existing, tubing tong. The break-out adapter fits the tubing tong with similar structure as the tubing jaws would be attached within the tongs if the tongs were to be used in their normal manner to break out tubing.

Some sucker rods do not have wrench flats. Often when the rods have wrench flats, the flats will not be at a convenient location. Therefore, it is desirable to attach the break-out attachment to the sucker rod by a vise which may be used on cylindrical portions of the sucker rod.

With the vise tightly clamped to the sucker rod, there is far less likelihood of it releasing from the sucker rod with violent and traumatic results. Also, the tubing tongs are well adapted to exert the torque and also the continued operation of rotating the sucker rod at high torque for up to 200 revolutions. Furthermore, the equipment is heavy enough and adapted to be anchored well enough that when the joint breaks there is a minimum of uncontrolled movement and trauma.

(2) Objects of this Invention.

An object of this invention is to remove pump elements from deep within a well.

Other objects of this invention are to break out and remove sucker rods from a well where the bottom of the sucker rod string is stuck within the well.

Further objects are to achieve the above with devices that are sturdy, compact, durable, simple, safe, efficient, versatile, ecologically compatible, energy conserving, and reliable, yet inexpensive and easy to manufacture, attach, operate, and maintain.

Other objects are to achieve the above with a method that is rapid, versatile, ecologically compatible, energy conserving, efficient, and inexpensive, and does not require highly skilled people to attach, operate, and maintain.

The specific nature of the invention, as well as other objects, uses, and advantages thereof, will clearly appear from the following description and from the accompanying drawings, the different views of which are not necessarily scale drawings.

Figure 1:
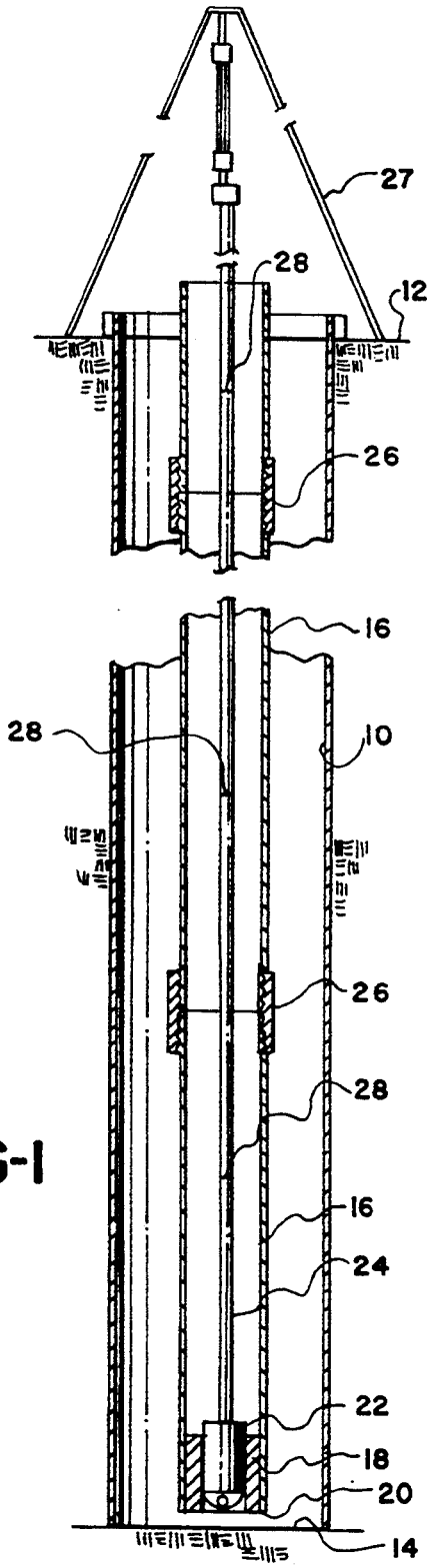
FIG. 1 is a schematic representation of a deep well with a pump far below the surface of the earth.

As an aid to correlating the terms of the claims to the exemplary drawing(s), the following catalog of elements and steps is provided:

10 casing
12 earth surface
14 well bottom
16 tubing
18 pump portion
20 bottom of tubing
22 pump elements
24 sucker rod string
26 tubing joints
27 pulling rig
28 rod joints
29 joint, broken
30 sucker rod break-out adapter
32 power tubing tong
34 vise
36 disconnected portion of rod string
38 remaining rod string
40 base
42 body
44 axis
46 cavity
47 bore
48 bolt
50 block
52 groove
54 anvil
56 head
58 base slot
60 tubing tong slot
62 rotatable means

DESCRIPTION OF THE PREFERRED EMBODIMENTS

Referring to FIG. 1 there may be seen a well deep within the earth. The well, as shown, includes casing 10 which extends from surface 12 of the earth to bottom 14 of the well.

Tubing 16 is telescoped within the casing 10 and anchored thereto by elements not pertinent to this invention and therefore not shown. Pump portion 18 is attached to bottom 20 of the tubing deep within the earth. As stated above the pump portions 18 may be 10,000 feet below the surface 12 of the earth. Pump elements 22 are telescoped within the pump portions 18 at the bottom of the well. They are attached to sucker rod string 24. Certain parts of the pump elements 22 are reciprocated by the reciprocal movement of the sucker rod string 24 thereby producing oil from the bottom of the well to the surface of the earth as is well known. Being well known, the details are not described here.

The tubing 16 will normally be in individual sections or portions which are connected by tubing joints 26. Likewise the sucker rod string is formed of individual parts which are joined together by sucker rod joints or rod joints 28. FIG. 1 is schematic and it will be understood that the length of the tubing and the distance between the joints of tubing, as well as between the joints of the sucker rod, have been greatly foreshortened for the purpose of illustration. Often the sucker rod itself will be 1½ inches in diameter and up to 30 feet in length, whereas the tubing will be 3 inches in diameter and up to 30 feet in length also.

To practice this invention, normally a pulling rig 27 will be moved to the site to maintain or repair the pump elements 22. By draw-works on the pulling rig, an attempt will be made to pull the sucker rod string 24 by upward, vertical tension. It will be understood that in the majority of the attempts the pump elements 22 will release from the pump portion 18 and the rod-string will move upward so that the rod joints 28 may be broken above the surface of the earth 12, each joint laid to one side until the entire pump element 22 is brought to the surface of the earth and maintained and repaired.

However, in some instances the pump elements 22 will not release from the pump portion 20 even though maximum tension is applied to the sucker rod string 24. Maximum tension would be that tension where there was a substantial danger of the sucker rod string failing in tension.

In such an instance it is necessary to torque the top of the sucker rod string to break some joint 28 of the sucker rod string.

The detailed description to this point describes well known equipment and procedures that are well known to the art.

Figure 2:
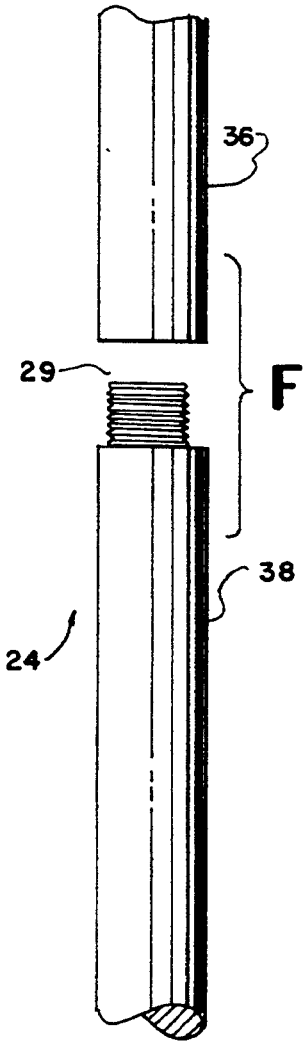
FIG. 2 is a side-elevational view of a disconnected sucker rod joint.

According to this invention, sucker rod break-out adapter 30 is attached to mechanically powered tubing tong 32 as described in detail later. With the adapter 30 attached to the tong 32 then vise 34 of the tong 32 is securely attached to the top of the sucker rod string 24 which projects above the top of the tubing 16 and thus the top of the rod string is rotated by the tong until one of the joints 28 breaks, as illustrated by broken joint 29.(FIG. 2)

Thereafter the adapter 30 is removed from the string 24 and the disconnected portion 36 is removed from the tubing string 16 by conventional procedures. The tubing string is then pulled (i.e. the tubing raised and the joint above the surface of the earth 12 broken). This continues until the top of remaining rod string 38 is exposed. Stated otherwise, the tubing string is pulled until structure other than tubing is exposed. I.e., if upon the opening of any joint there is no unexposed structure, then another joint is pulled.

Then the process steps identified above repeated. I.e., there is an attempt to pull the remaining rod string 38 with the attached pump elements 22 from the tubing, hoping that the trauma of the breaking of the joint 29 will have freed the pump portions 22. If this is successful, of course, it is pulled and the repair and maintenance steps are carried out at that time. If the attempt to pull the remaining rod string is not successful the remaining steps above are carried out. I.e., an adapter is again placed in the tubing tongs, another joint 28 below the surface of the earth is broken, the disconnected portion 36 of the rod string is pulled, and the tubing is pulled until again a remaining rod 38 string is exposed.

By repeating the above, at some point the pump portion 22 will be brought to the surface of the earth. The pump is returned to the well by standard, well known, oil well servicing procedures.

Figure 3:
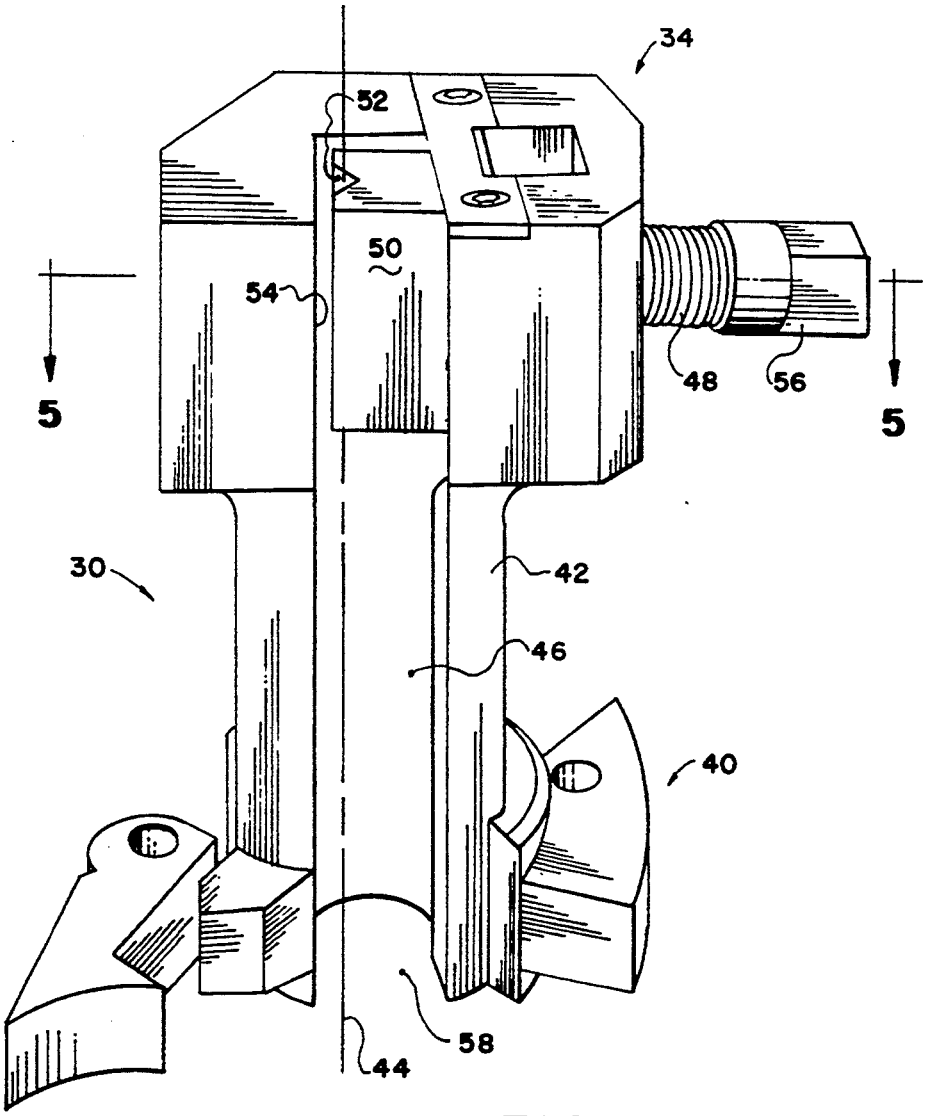
FIG. 3 is a perspective view of a sucker rod break-out adapter according to this invention.
Figure 5:
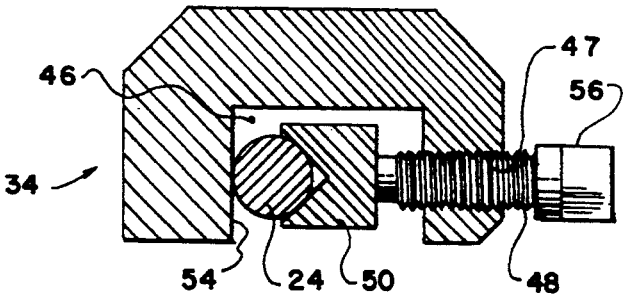
FIG. 5 is a cross-sectional view taken substantially on line 5—5 of FIG. 3 showing the threaded bore and the vise bolt therein.

Referring more particularly to FIG. 3 there may be seen a sucker rod break-out adapter. The adapter has a base 40 which is designed, manufactured, and adapted to fit into a standard tubing tong. For example,, one base 49 will fit into a "JB Tubing Tong" or a "Weatherford Tubing Tong" or an "Oil Country Tubing Tong". The tongs named above are all mechanically powered tubing tongs. In fact, all three are powered by pressurized fluid such as hydraulic fluid or compressed air. All of the above named tubing tongs are built to receive a standard jaws or unit for fitting tubing jaws into the tongs to fit different sized tubing. However, in this case the elements that fit into that are merely to adapt it so that the break-out adapter can be fit into the tubing tongs.

Figure 4:
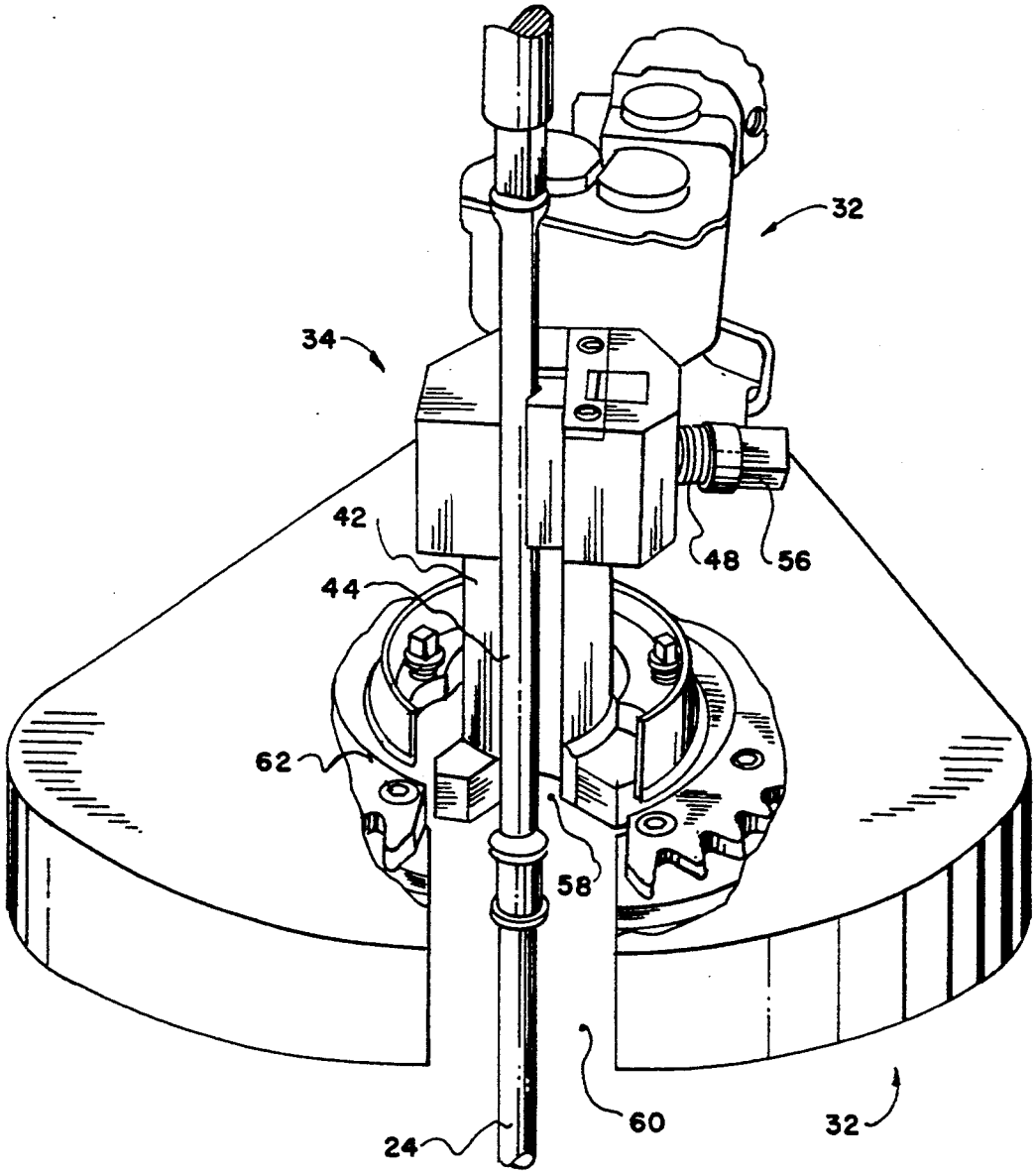
FIG. 4 is a perspective view of a sucker rod break-out adapter according to this invention tightly clamped to a sucker rod and also with the adapter in place in a mechanical tubing tong.

The adapter is so built and constructed to have an elongated body 42 attached to the base 40 which has axis 44. The body has cavity 46 around-the axis. Threaded bore 47 extends radially from the axis of the body 42. Vise bolt 48 is threaded into the threaded bore 47. Vise bolt 48 bears against the vise block 50. As may be seen, the vise block has "V" shaped groove 52 therein. This is so arranged and adapted so that a sucker rod of the string 24 may be placed against anvil 54 forming a portion of the boundaries of the body and therefore the sucker rod can be tightly clamped between the bloc and the anvil as particularly seen in FIG. 4.

Of course, as may be seen in the drawing, the vise bolt 48 has square head 56 so that a suitable wrench may be used to tighten the vise bolt 48 against the vise block 50 to securely clamp the sucker rod to the body 42 of the adapter 30.

Also, it may be seen that the cavity 46 is open on one side so that the sucker rod can be moved laterally into the cavity. Also from the drawing it may be seen that there is opening or slot 58 in the base 40 of the body to permit this lateral movement of the sucker rod into place.

Those skilled in the art will know that the tubing tongs 32 likewise have slot 60 to accommodate this. The provision of such slots is well known and understood by those skilled in the art.

It is reiterated that the base 40 of the sucker rod break-out adapter 30 fits securely, rigidly and regularly onto the power tubing tong 32 in a position that is standard on many different tubing tongs as set out above. I.e., the sucker rod break-out adapter 30 fits onto these tongs just as securely and that the base would fit exactly the same as the normal gripping jaws would fit on the tubing tong 32 if the tubing tongs were to be fitted with tubing jaws to grip tubing rather than the sucker rod break-out adapter 30 to be attached to sucker rod.

It will be understood that the unit upon the tubing tongs to which the gripping jaws would be attached is a rotatable means having an axis on the tubing tong for inserting cam operated tubing jaws and is identified in the drawing by numeral 62.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. A method of removing sucker rods from deep wells, said rods formed by joints in a rod string through tubing in the well and said rod string attached to pump elements far below the surface of the earth, and said pump elements being stuck to a well structure; comprising the steps of:

a) fitting a sucker rod break-out adapter to a mechanically powered tubing tong in the same manner and at the same position as tubing gripping jaws are fitted to said tubing tongs;

b) attaching said adapter having a vise jaw to said sucker rod string, by c) screwing said vise jaw against the sucker rod, and d) rotating said adapter by said tong thereby e) breaking a joint in the rod string.

2. The method as defined in claim 1 wherein prior to the step a recited in claim 1, first f) attempting to pull the rod string and said attached pump elements.

3. The method as defined in claim 1 wherein the recited steps results in f) creating a disconnected portion and a remaining portion of the rod string, and further comprising the steps of:

g) removing said adapter from the disconnected portion of the rod string, h) pulling the disconnected portion of the rod string, and j) pulling the tubing to a point where structure other than the tubing is exposed.

4. The method as defined in claim 3 further comprising:

k) repeating all the above steps until the pump elements are removed.

5. A method of removing sucker rods from deep wells, said rods formed by joints in a rod string through tubing in a well and said rod string attached to pump elements far below the surface of the earth, and said pump elements being stuck to a well structure; comprising the steps of:

a) attempting to pull the rod string and attached pump elements, and when the attempt is unsuccessful, then b) fitting a sucker rod break-out adapter to a mechanically powered tubing tong in the same manner and at the same position as tubing gripping jaws are fitted to said tubing tongs, then c) attaching said adapter to said sucker rod string, d) rotating said adapter by said tong thereby e) breaking a joint in the rod string, thereby f) creating a disconnected portion of rod string, g) removing said adapter from the disconnected portion of the rod string, h) pulling the disconnected portion of the rod string, j) pulling the tubing to a point where structure other than the tubing is exposed, and k) repeating the above steps until said pump elements are removed.

6. The method as defined in claim 5 wherein the adapter has a use jaw, and the step of attaching the adapter to the sucker rod string comprises:

l) screwing said vise jaw against the sucker rod.

7. A tubing tong having an adapter thereon for breaking stuck sucker rods having an axis comprising:

a) a mechanically powered tubing tong having b) rotatable means on said tubing tong for inserting cam operated tubing jaws therein, bb) said rotatable means having an axis, c) a sucker rod break-out adapter inserted in said rotatable means in the same manner and at the same position as said cam operated tubing jaws are inserted, d) said sucker rod break-out adapter having i) an elongated body with an elongated axis, ii) an elongated cavity surrounding the body axis adapted to receive a sucker rod co-axially with the adapter body, iii) a threaded bore in said body, said radial bore extending radially from said axis, iv) a threaded vise bolt in said bore, and v) a vise block in said cavity contacted by said vise bolt, e) so arranged and constructed that a sucker rod may be securely attached to said tubing tong by clamping the sucker rod in the cavity by tightening the vise block by rotation of the vise bolt.

* * * * *